US007390010B2

(12) United States Patent
Elkington et al.

(10) Patent No.: US 7,390,010 B2
(45) Date of Patent: Jun. 24, 2008

(54) SNOWBOARD BINDING

(75) Inventors: Mark Elkington, Hong Kong (HK); Ralph Kohler, Oberperfuss (AT)

(73) Assignee: Goodwell International Ltd., Tortola (VG)

( * ) Notice: Subject to any disclaimer, the term of this patent is extended or adjusted under 35 U.S.C. 154(b) by 595 days.

(21) Appl. No.: 10/939,877

(22) Filed: Sep. 13, 2004

(65) Prior Publication Data

US 2005/0062260 A1 Mar. 24, 2005

(30) Foreign Application Priority Data

Sep. 19, 2003 (DE) ..... 103 43 887

(51) Int. Cl.
*A63C 9/02* (2006.01)

(52) U.S. Cl. ..... 280/618; 280/11.3; 280/14.24; 280/623

(58) Field of Classification Search ..... 280/11.3, 280/11.31, 11.32, 11.33, 11.34, 14.21, 14.22, 280/14.23, 14.24, 14.25, 14.26, 611–618, 280/623–637, 809, 811
See application file for complete search history.

(56) References Cited

U.S. PATENT DOCUMENTS

| | | | | |
|---|---|---|---|---|
| 5,890,729 | A * | 4/1999 | Bayer et al. | 280/618 |
| 5,984,346 | A | 11/1999 | Keller | |
| 6,007,085 | A * | 12/1999 | Rigal et al. | 280/607 |
| 6,234,494 | B1 * | 5/2001 | Gien | 280/14.24 |
| 6,467,794 | B1 * | 10/2002 | De France | 280/607 |
| 6,945,544 | B2 * | 9/2005 | Feurer et al. | 280/14.22 |
| 2003/0011171 | A1 * | 1/2003 | Battistella | 280/618 |
| 2004/0100069 | A1 * | 5/2004 | Cumby | 280/618 |
| 2004/0188983 | A1 * | 9/2004 | Scholten | 280/618 |
| 2004/0207166 | A1 | 10/2004 | Elkington | |

FOREIGN PATENT DOCUMENTS

| | | | |
|---|---|---|---|
| DE | 295 01 515.2 | U1 | 2/1995 |
| DE | 196 27 808 | A1 | 7/1996 |
| DE | 103 13 342 | A1 | 3/2003 |
| EP | 0 351 298 | A2 | 1/1990 |
| EP | 0 840 640 | B1 | 5/1998 |
| FR | 2 575 660 | A1 | 7/1986 |
| FR | 2 627 097 | A1 | 8/1989 |
| WO | 89/08480 | A1 | 9/1989 |

* cited by examiner

*Primary Examiner*—Christopher P. Ellis
*Assistant Examiner*—John Walters
(74) *Attorney, Agent, or Firm*—Senniger Powers

(57) ABSTRACT

The snowboard binding comprises a base plate that can be fastened at a spacing from the surface of the snowboard, a pin plate arranged between the surface of the snowboard and the base plate, from which pin plate several pins project, each of which extends through a recess of the base plate. In addition, it comprises a mounting plate with a central opening and comprises a retention plate comprising openings associated with the pins, which retention plate overlaps the opening of the mounting plate. Each of the pins has an annular groove. A tensioning plate has oblong holes formed as circular ring segments, associated with the pins and whose at least one lateral wall has an oblique run-up surface that engages into the particular annular groove.

19 Claims, 8 Drawing Sheets

SNOWBOARD BINDING

FIELD OF THE INVENTION

The invention relates to a snowboard binding.

BACKGROUND OF THE INVENTION

DE 196 27 808 A1 shows a snowboard binding with a base plate that can be fastened by screws to the surface of a snowboard. Four threaded stay bolts extend vertically from the base plate. A flange plate has holes associated with these threaded stay bolts and has a cogging on its circumferential edge that engages in a countercogging of a customary mounting plate of a snowboard binding. The flange plate is held in a non-rotating manner on the threaded stay bolts but can be shifted linearly along the axis of the threaded stay bolts, wherewith the cited cogging can be loosened from the countercogging. A tensioning disk is arranged above the flange plate and has oblong perforations associated with the threaded stay bolts. Screw bushings with a widened head are inserted into these oblong holes and can be screwed into the threaded stay bolts. The longitudinal holes have lateral edges rising up like a ramp on which the widened heads of the screw bushings are supported. The screw bushings can change their spacing to the snowboard surface on account of the ramp-like edges of the longitudinal holes by means of rotating the tensioning disk relative to the stationary screw bushings, as a result of which the flange plate held in a non-rotating manner can be raised or lowered and its cogging can be brought into or out of engagement with the countercogging of the base plate. In the loosened state the base plate and therewith the entire binding can be rotated relative to the longitudinal axis of the snowboard.

U.S. Pat. No. 6,007,085A shows a snowboard binding with a base plate that can be fastened directly onto the surface of the snowboard and comprises a central cylindrical projection with a threaded bore. This projection extends into an opening of a mounting plate of the binding, which opening is significantly larger than the projection so that the mounting plate can be shifted in the plane of the snowboard surface into two directions that are perpendicular relative to each other. In order to fasten the mounting plate relative to the base plate, a retention plate covering the opening of the mounting plate is used that can be fixed by a screw screwed into the threaded bore of the base plate.

EP 0 351 298 A2 shows another binding with a base plate that can be fastened by screws to the surface of a snowboard. The base plate has a recess in the form of an oblong hole through which a single central pin extends that projects from a pin plate that is arranged between the bottom of the base plate and the top of the snowboard and that can be shifted in the direction of this oblong hole. A mounting plate of the binding can be set onto the base plate. The mounting plate also has a recess through which this pin extends. The customary fastening elements for holding a shoe are attached to the mounting plate. A retention plate is arranged above the mounting plate and has a central recess through which a screw is inserted and can be screwed into a thread of this pin of the tensioning plate. Thus, when the screw is tightened, the mounting plate is fixed between the retention plate and the base plate in that the retention plate is drawn against the tensioning plate. The entire unit consisting of tensioning plate, mounting plate and retention plate can be shifted in the oblong hole by loosening the screw, wherewith the position of the binding can be adjusted in a longitudinal direction. The screw has an actuating handle so that it can also be tightened and loosened manually, that is, without tools.

EP 0 840 640 B1 shows a similar binding in which, however, the base plate with an oblong hole is introduced into the body of the snowboard and has a box-shaped profile with a longitudinal slot.

A similar binding is also shown in DE 295 01 515 U1 in which a guide profile is also introduced into the body of the snowboard. Instead of the retention plate, only a central screw is provided that extends through a corresponding bore of the mounting plate. Such a binding is also shown in FR 2 575 660 A1.

All the cited bindings have the common features that the position of the binding can be adjusted in a simple manner without tools only in one direction, that is usually the longitudinal direction of the snowboard, and that the fixing of the binding always takes place in this state of the art by frictional forces. In a few of these bindings such as, e.g., EP 0 840 640 B1 and EP 0 351 298 A2, the position of the rotation of the mounting plate can additionally be adjusted relative to an axis of rotation vertical to the snowboard surface.

FR 2 627 097 A1 and WO 98/08480 A1 also show snowboard bindings in which only the position of the rotation of the mounting plate can be changed without tools. In FR 2 627 097 A1 linearly shiftable toothed racks are attached to a rotary plate and engage into a countercogging. The shifting of the toothed racks takes place with a lever as a result of which the cogging can be opened or closed. In the case of WO 98/08480 A1 the mounting plate is fastened on a rotary plate and a catch pin that can shift vertically to the snowboard surface is attached to the rotary plate and can engage in holes of a counterplate. In these last-cited bindings only the position of rotation of the binding can be adjusted, but not its position relative to the surface of the snowboard.

All these bindings have the essential purpose of simplifying the particular adjustment so that these bindings are particularly suited for snowboard renting, in which instance bindings must frequently be adjusted to other skiers. Such bindings are also suitable for persons who would like to experimentally find their optimal binding position and would like to rapidly try out other binding positions or alignments on the course and without tools.

In general, the adjustment of the position and alignment of a snowboard binding should have three degrees of freedom, namely, In the longitudinal direction of the snowboard, In the transverse direction of the snowboard, and In reference to an axis of rotation vertical to the snowboard surface, in which the adjustment should take place without stages or with fine stages to the extent possible. It is desirable, as in the cited state of the art, if the adjustment can be carried out simply and without tools. Finally, the particular adjusted position should also be able to be reliably retained even under high forces like those occurring between the binding and the snowboard during snowboarding.

The older, not pre-published German patent application DE 103 13 342 explains a snowboard binding that meets these requirements. In it, a recess is provided in the base part which recess is so large that an adjustment is possible along two axes of a Cartesian coordinate system in the plate of the snowboard surface and that the fixing of the position takes place by positive cogging in both cited axes of the Cartesian coordinate system. This cogging is provided between the top of the tensioning plate and the bottom of the base plate as well as between the top of the base plate in the bottom of the retention plate. Note also that the pin plate has only one coaxial central pin here.

SUMMARY OF THE INVENTION

This invention undertakes to improve the initially cited snowboard binding in such a manner that it has three degrees of freedom of adjustment possibilities, that the particular adjusted position is reliably retained and that the adjustment is possible in a simple manner.

This problem is solved by the features indicated in Claim 1. Advantageous embodiments and further developments of the invention can be gathered from the dependent claims.

The basic concept of the invention resides in providing a pin plate with several pins that extend through associated oblong holes of the base plate and through associated holes of the retention plate, wherein each pin has an annular groove in the vicinity of its free end. Furthermore, a rotatable tensioning plate with oblong holes shaped like annular segments is provided whose side walls have run-up oblique surfaces that engage into said grooves of the pins. A rotation of the tensioning plate thus causes the pin plate to be secured in place from below and the rotary plate together with the mounting plate from above against the base plate. A finely graduated cogging is provided between the top of the pin plate and the bottom of the base plate so that during said securing in place a positive connection is established that positively defines the relative position in one direction of the Cartesian coordinate system (x direction). A positive possibility of adjustment is also present in the direction (y direction) vertical to the one above and also in the plane of the snowboard surface in that the rotary plate comprises several holes located successively in this direction (y direction) for the passage of the pins so that in this case too several positions are possible.

According to a further development of the invention a locking plate is provided that comprises locking pins on its bottom that engage through associated holes of the tensioning plate into associated holes of the rotary plate and thus fix the tensioning plate against rotation. In addition, the locking plate can be used as a tool. To this end it has at least one and preferably two lateral projections on its edge that engage into recesses on the top of the tensioning plate and thus function as a "tool" for rotating the tensioning plate. In addition, other positive connections can be provided between the locking plate and the tensioning plate and also between the locking plate and the rotary plate via which connections the cited parts can be fixed to each other in a non-rotating manner. These plates, that is, the base plate, pin plate, retention plate, tensioning plate and locking plate are preferably made in one piece. They can be manufactured from any desired material with sufficient strength such as, e.g., metal, glass or carbon-fiber-reinforced plastic, etc.

BRIEF DESCRIPTION OF THE DRAWINGS

The invention is explained in more detail in the following using an exemplary embodiment in conjunction with the drawings.

The same reference numerals in the individual figures designate the same parts or parts corresponding functionally to each other.

DETAILED DESCRIPTION OF THE DRAWINGS

This application claims priority from German Patent Application 103 43 887.4 filed Sep. 19, 2003, the entire disclosure of which is expressly incorporated herein by reference.

Figure 1:
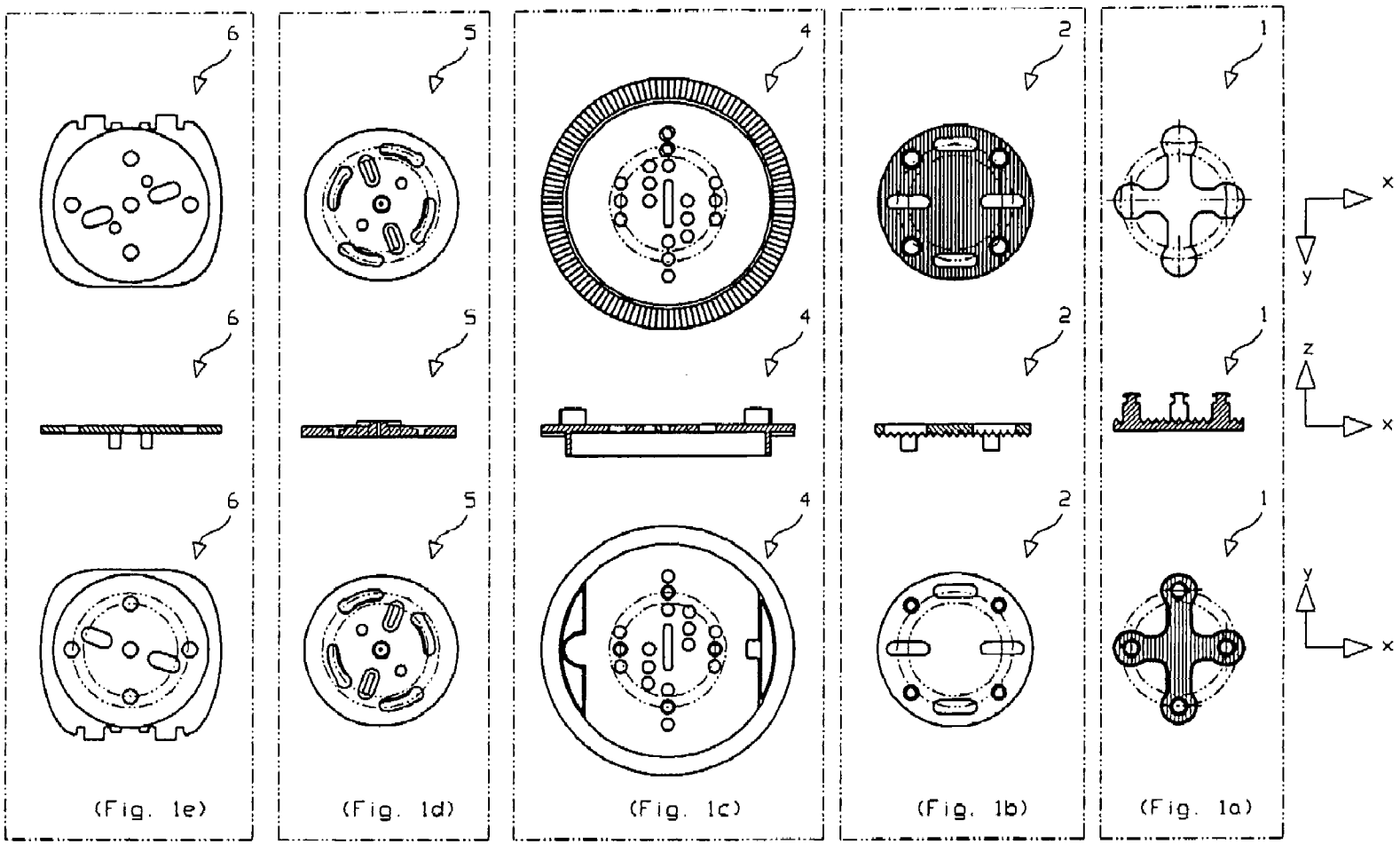
FIG. 1 shows an overview of the individual parts of the snowboard binding in accordance with the invention (with the exception of the mounting plate) in a top view, sectional view and bottom view.

FIG. 1 is referred to first. The snowboard binding has a pin plate 1, a base plate 2, a mounting plate 3 (cf. FIGS. 2, 3), a retention plate 4, a tensioning plate 5 and a locking plate 6 that are set on top of each other in the mounted state in this sequence, starting from the top of a snowboard S (cf. FIG. 3).

Figure 1A:
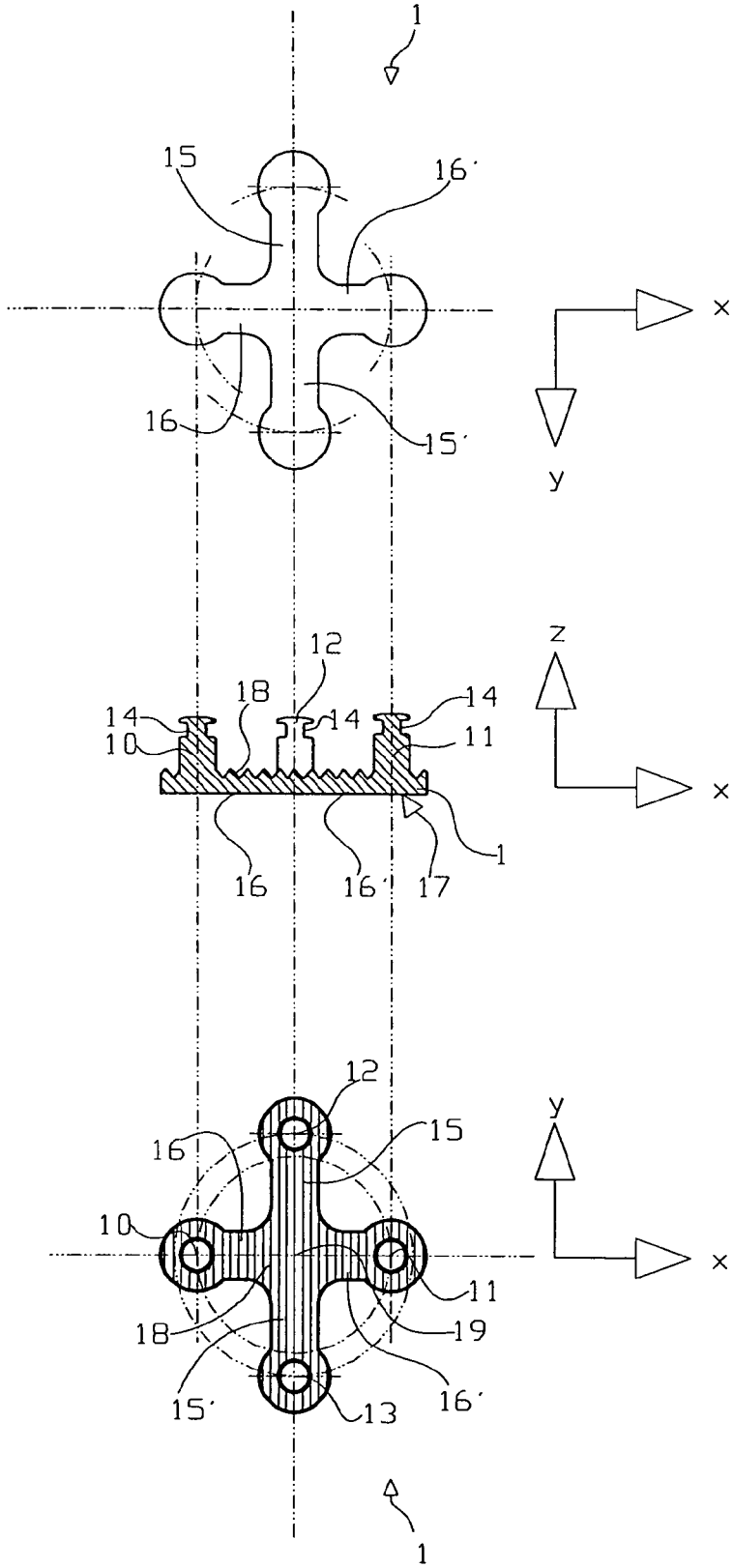
FIG. 1*a* shows three corresponding views of the pin plate.

Pin plate 1 (cf. FIG. 1*a*) has four pins 10, 11, 12 and 13 projecting vertically in the z direction and comprising annularly circumferential groove 14 in the vicinity of their free end. The pin plate has four arms 15, 15' and 16, 16' to whose free ends pins 10–13 are attached. Arms 15, 15' and 16, 16' are at right angles to each other in the top view and have different lengths so that one pair of pins 10, 11 has a smaller spacing from middle point 19 than the other pair of pins 12, 13 does. A bottom 17 of the pin plate facing away from pins 10–13 faces in the mounted state the surface of a snowboard S shown in FIG. 3. Cogging 18 is provided on the top of pin plate 1 opposite bottom 17. The teeth of this cogging run in a straight line in the direction of the longitudinal axis of arm 15, 15', that is, in the direction of arrow y. The surface of snowboard S is in the x, y plane, and the z axis is vertical to this plane.

Figure 1B:
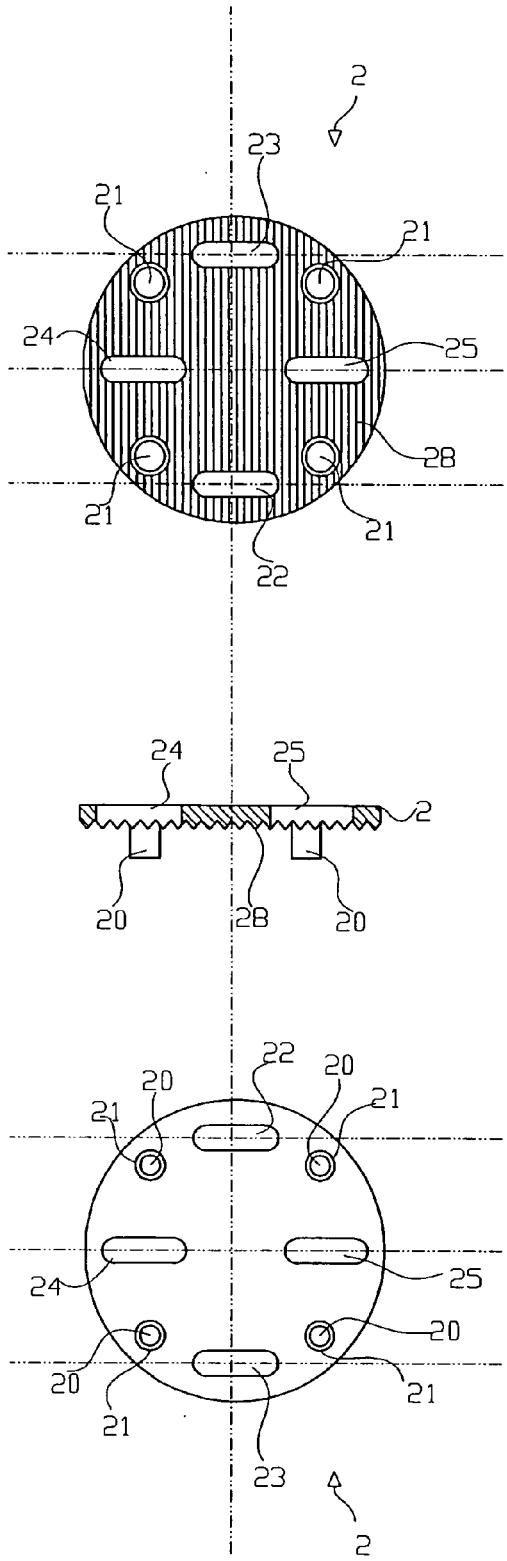
FIG. 1*b* shows three corresponding views of the base plate.

Base plate 2 (FIG. 1*b*) has the shape of a circular disk from whose bottom four posts 20 project, each of which has a central bore 21. Posts 20 are arranged in a square here that corresponds to the customary insert pattern of screw fastenings on snowboards of 4×4 cm. Of course, other patterns are also possible, e.g., the posts can be arranged in the form of an equilateral triangle. Base plate 2 stands with the free ends of posts 20 on the surface of snowboard S and is screwed to the snowboard with screws (not shown) inserted into bores 21. As a result of the length of posts 20, which correspond approximately to the thickness of pin plate 1, base plate 2 is at a spacing from snowboard surface S, which spacing is greater than the thickness of pin plate 1 in order that when base plate 2 is screwed fast, pin plate 1 can still be shifted in the x and the y directions. In the assembled state of the binding, posts 20 overlap arms 15, 15' and 16, 16' of the pin plate, that is, they engage into the intermediate spaces between arms 15, 15' and 16, 16'. Base plate 2 has a number of oblong holes 22, 23, 24 and 25 corresponding to the number of pins 10–13 of pin plate 1 and are arranged in such a manner that each pin 10–13 can extend through one of oblong holes 22–25.

Cogging 28 is provided on the bottom of base plate 2 facing the snowboard surface and corresponds to cogging 18 of pin plate 1 so that base plate 2 and pin plate 1 positively interlock via these coggings 18, 28. By virtue of oblong holes 22–25 pin plate 1 can shift relative to base plate 2 transversely to the longitudinal direction of coggings 18, 28. Oblong holes 22–25 accordingly run perpendicularly to the longitudinal direction of teeth 28.

Note also that for the instance that posts 20 are arranged in a non-square pattern, e.g., a triangular pattern, pin plate 1 is also to be altered correspondingly, e.g., so as to have three arms at an angle of 120° to one another and three pins so that the posts can always engage between the arms.

Figure 1C:
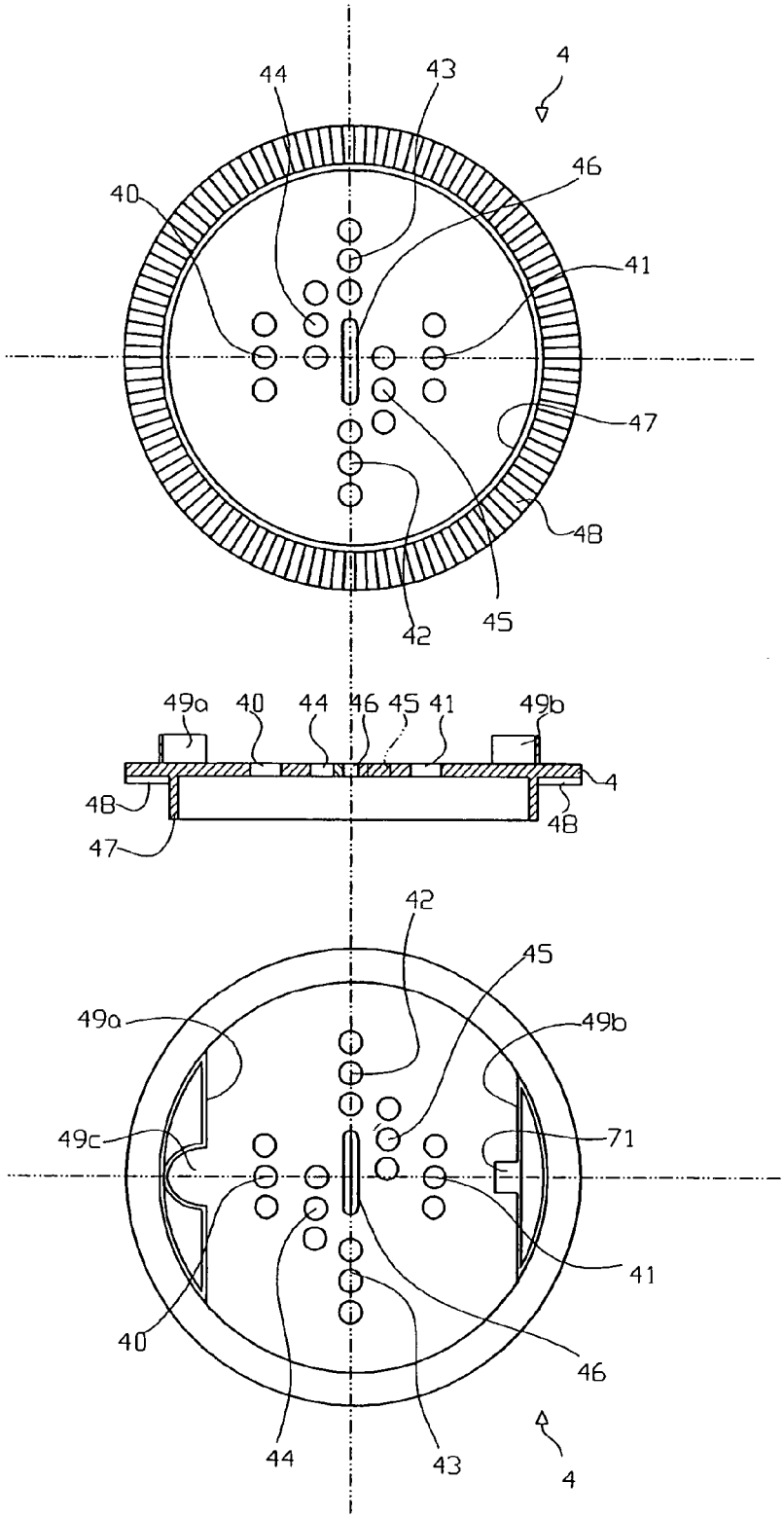
FIG. 1*c* shows three corresponding views of the retention plate.

Retention plate 4 in FIG. 1*c*, which is also designated as a rotary plate, has the shape of a circular disk in the top view. This disk has four rows of passage holes 40–43 aligned in the longitudinal direction of teeth 18, whose arrangement otherwise corresponds to the arrangement of pins 10–13 and the diameter of which also corresponds to the diameter of pins 10–13. In the arrangement shown here of three passage holes per row, retention plate 4 can thus be set onto pins 10–13 in three different positions. Due to the different lengths of arms 15, 15' and 16, 16' of pin plate 1, retention plate 4 can also be set on pins 10–13 only in one orientation of rotation. Instead of the individual passage holes per row one oblong hole per row can also be provided, in which instance the alignment of the oblong holes is then perpendicular to the alignment of oblong holes 22–24 of base plate 2 in the assembled position.

Base plate 2 is screwed firmly on the snowboard surface during use. Pin plate 1 can then shift in the longitudinal direction of oblong holes 22–25 with a fine graduation according to one tooth width of coggings 18, 28 at a time and can be locked by the teeth. Since pins 10–13 also engage into passage holes 40–43, retention plate 4 is also moved therewith in the same direction relative to base plate 2. In the direction perpendicular thereto the retention plate can be placed in different manners via the rows of passage holes 40–43 or can be infinitely shifted relative to the base plate when using oblong holes.

Furthermore, retention plate 4 has two rows of locking holes 44, 45 aligned in the same direction as passage holes 40–43 and also having the same spacing to one another. In this instance too an appropriately aligned longitudinal hole can also be provided instead of the rows of several holes (three are shown). The function of these locking holes 44, 45 will be explained further below. Furthermore, retention plate 4 has central oblong hole 46 whose middle is located in the center of the circle of the retention plate and whose longitudinal extent is also aligned in accordance with the arrangement of passage holes 40–43 and of locking holes 44, 45. The function of this central oblong hole 46 will also be explained further below.

An annular, projecting edge 47 is provided on the bottom of retention plate 4 facing snowboard surface S, the axial length of which edge is slightly shorter than the thickness of base plate 2 including the length of posts 20. If retention plate 4 is resting on the top of base plate 2, edge 47 thus has a small spacing to snowboard surface S. The radius of edge 47 is smaller than the diameter of retention plate 4 so that a part of retention plate 4 extends radially over edge 47. Annular gear ring 48 is provided on the bottom of this projecting part and facing the snowboard surface which ring meshes into corresponding countercogging 32 (see FIG. 2) of mounting plate 3. Mounting plate 3 can be rotated via this gear ring 48 and cogging 32 about an axis of rotation vertical to the plane of the drawing in FIG. 1 and be stopped in fine graduations in the direction of rotation.

Two projections 49*a*, 49*b* also project from the top of the retention plate facing away from the snowboard surface S, the function of which projections will also be explained further below.

Figure 1D:
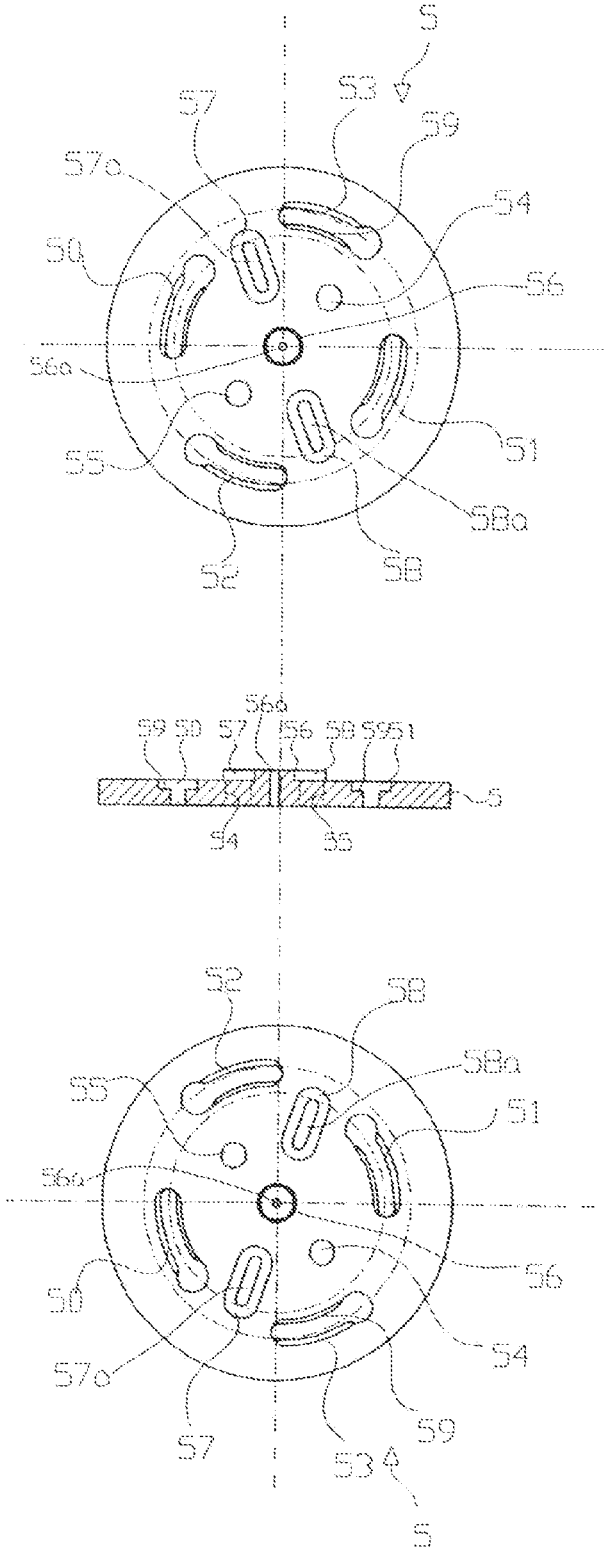
FIG. 1*d* shows three corresponding views of the tensioning plate.

Tensioning plate 5 of FIG. 1*d* is also designed as a circular disk. It has four oblong holes 50–53 in the form of circular ring segments and run in pairs (50, 51 and 52, 53) on circular tracks with different radii in accordance with the differing intervals of pins 10–13 from center 19 of pin plate 1. The oblong holes have a widened end adapted to the diameter of pins 10–13 so that the pins can be introduced there into oblong holes 50–53. Furthermore, the oblong holes have oblique lateral run-up surfaces 59 that engage into groove 14 of the particular pin 10–13. Thus, when tension plate 5 is rotated, plate 1 is drawn upward away from snowboard surface S by the cooperation of grooves 14 and of oblique run-up surfaces 59 and is pressed against the bottom of base plate 2. Furthermore, tensioning plate 5 is pressed against the top of retention plate 4 by this process so that the entire arrangement of pin plate 1, base plate 2, mounting plate 3, retention plate 4 and tensioning plate 5 is firmly secured in place.

If tensioning plate 5 is in its limit position of being secured in place, that is determined by the length of oblong holes 50–53, lock holes 54 and 55 of tensioning plate 5 are aligned with lock holes 44, 45 of retention plate 4.

Tensioning plate 5 has central, circular flange 56 projecting on its surface in the z direction and with central hole 56*a* and also has two likewise axially projecting edges 57, 58 each of which is arranged around an oblong hole 57*a* and 58*a*. These two oblong holes 57*a*, 58*a* are aligned along a straight line passing through the circular center of tensioning plate 5.

Figure 1E:
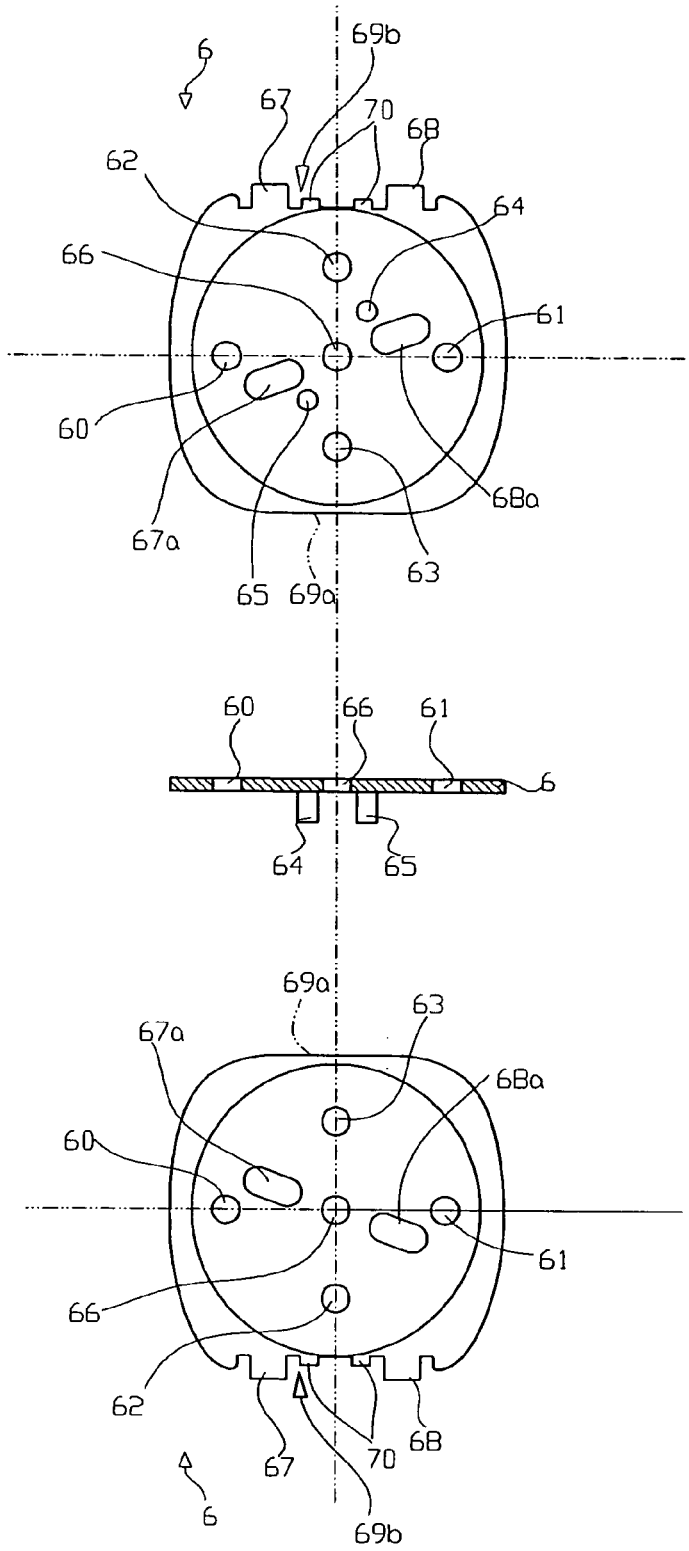
FIG. 1*e* shows three corresponding views of the locking plate.

Locking plate 6 of FIG. 1*e* is designed as a level disk. It has four passage holes 60, 61, 62 and 63 arranged in accordance with the pattern of pins 10, 11, 12 and 13. Moreover, locking plate 6 has two pins 64, 65 projecting from its bottom facing snowboard surface S that are arranged and aligned in accordance with the arrangement of holes 54, 55 of tensioning plate 5. In addition, it has two oblong holes 67*a*, 68*a* arranged and aligned in accordance with edges 57, 58 of tensioning plate 5. Furthermore, it has central hole 66 whose diameter is adapted to the diameter of flange 56.

Locking plate 6 has edge 69*a* running in a straight line on one side and parallel to said edge on the opposite side it has edge 69*b* with several recesses so that rectangular projections 67, 68 are formed whose dimensions correspond to holes 57*a*, 58*a* of tensioning plate 5. The two projections 67, 68 function as tools for rotating tensioning plate 5. Furthermore, two smaller projections 70 are formed on edge 69*b*. Projection 71 on wall 49*b* of retention plate 4 engages between these projections. Straight-line edge 69*a* of locking plate 6 rests on projection 49*a* of retention plate 4 and pins 64, 65 of locking plate 6 extend through holes 54, 55 of tensioning plate 5 into holes 44, 45 of the retention plate, wherewith locking plate 6 locks tensioning plate 5 relative to retention plate 4 and is also secured against rotation via edge 69*a* and projections 70. In addition, flange 56 of tensioning plate 5 engages into central hole 66, which centers and also holds locking plate 6.

Figure 2:
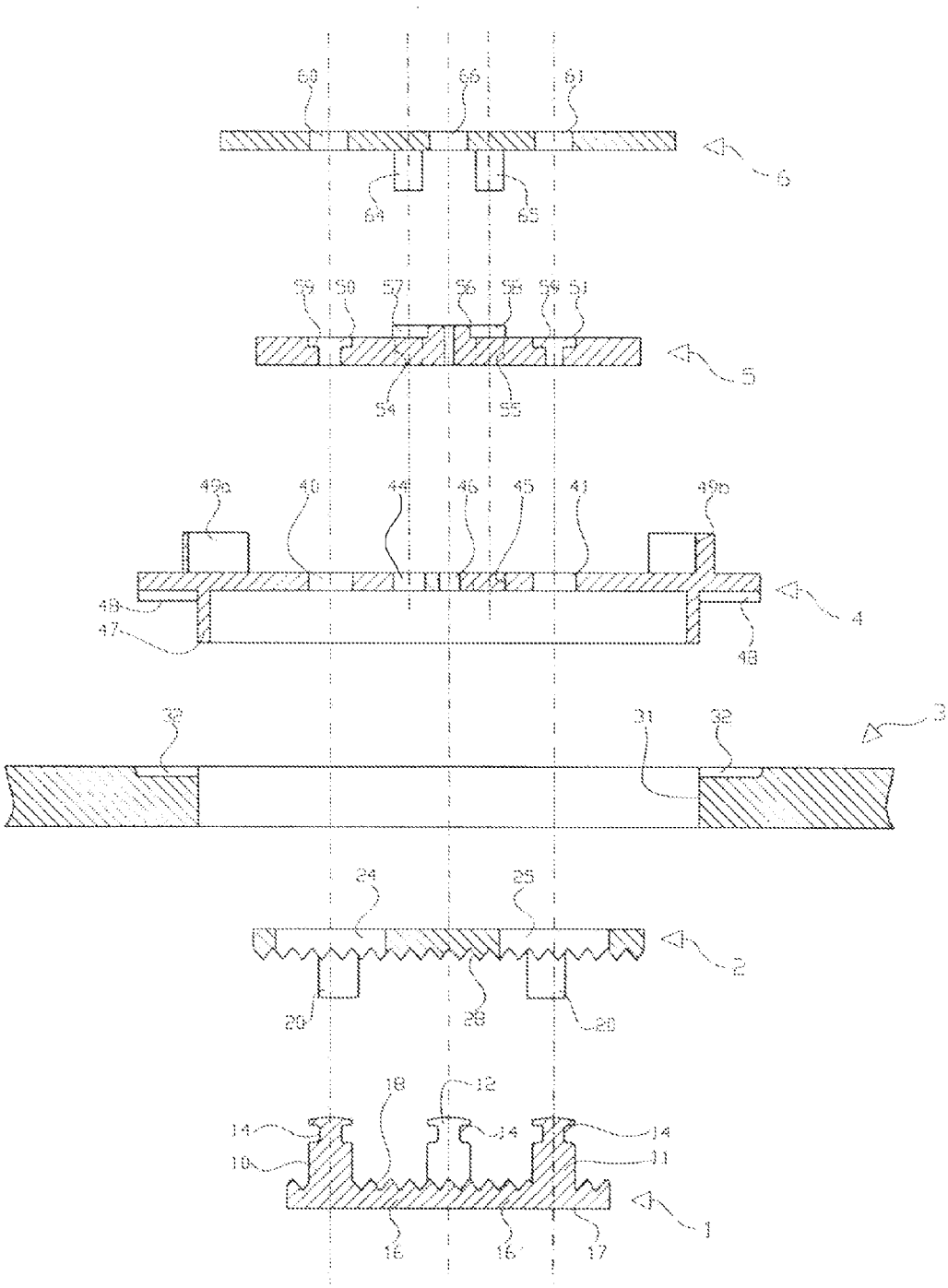
FIG. 2 shows an exploded sectional view of the snowboard binding of the invention.
Figure 3:
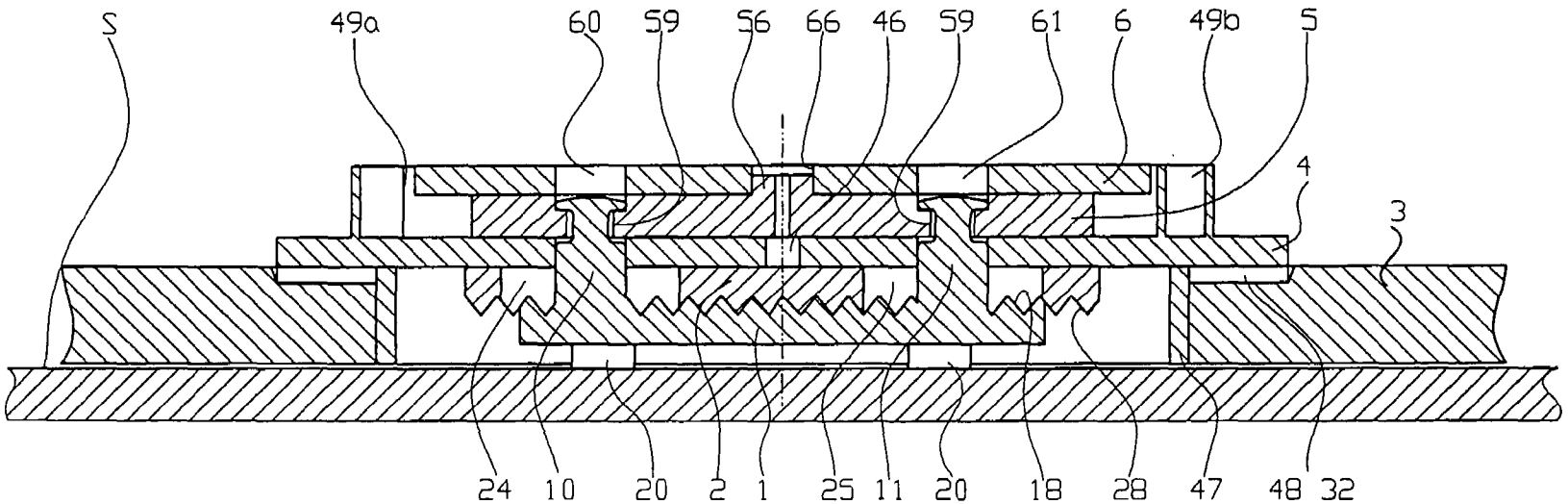
FIG. 3 shows a sectional view of the snowboard binding in the mounted state.

It is easier to recognize from the exploded view of FIG. 2 and the sectional view of FIG. 3, how the snowboard binding is composed. At first, pin plate 1 is set with its bottom 17 onto the surface of snowboard S. Then, base plate 2 is set from above over the pin plate so that posts 20 extend between arms 15, 15' and 16, 16' through the pin plate and pins 10–13 extend through oblong holes 22–25. Posts 20 are then screwed to so-called inserts on snowboard S. The bottom of base plate 2 with its cogging 28 still has such a spacing opposite cogging 18 of pin plate 1 that pin plate 1 can be freely shifted in the plane of the snowboard surface (x plane/y plane) opposite base plate 2 within the limits defined by posts 20 in cooperation with arms 15, 15' and 16, 16'. Then, mounting plate 3 is set over the unit consisting of pin plate 1 and base plate 2. Mounting plate 3 has central opening 31 whose diameter is greater than the diameter of pin plate 1 or of base plate 2 including their possibility of shifting. Gear ring (cogging) 32 is attached to the edge of opening 31 of mounting plate 3, faces radially away from opening 31 and extends around opening 31.

Mounting plate 3 has the customary fastening devices (not shown in detail here) for fastening a boot to the binding. Any fastening devices known in the state of the art can be used here such as, e.g., instep straps, toe straps, heel supports (so-called highbacks) as well as other known fastening devices of shoe-binding combinations such as catch pins, tightening levers, etc.

In the next step retention plate 4 is inserted with its annular edge 47 into opening 31 of mounting plate 3 in such a manner that pins 10–13 extend through openings 40–43; for positioning in the y direction (FIG. 1) respectively one of holes 40–43 of the rows of holes is selected.

Next, tensioning plate 5 is set on in such a manner that pins 10–13 extend through oblong holes 50–53 of tensioning plate 5, namely, through the widened openings on one end of oblong holes 50–53. Then, locking plate 6 is used as a tool in such a manner that projections 67, 68 engage into openings 57*a*, 58*a* of the tensioning plate. Then tensioning plate 5 is rotated with locking plate 6 as a tool, during which oblique run-up surfaces 59 engage into grooves 14 of pins 10–13. As a result of this process, pin plate 1 is pressed from below and retention plate 4 together with mounting plate 3 from above against base plate 2. Then, coggings 18 and 28 intermesh so that the binding is also positioned in the x direction. Tensioning plate 5 is rotated thereby until it comes to strike the end of oblong holes 50–53. In this position holes 54, 55 of tensioning plate 5 are also then aligned with holes 44, 45 of retention plate 4.

In the last step locking plate 6 is set on tensioning plate 5. It is centered over central hole 66 on flange 56; pins 64, 65 engage through holes 54, 55 of the tensioning plate into holes 44, 45 of retention plate 4, and edges 57, 58 of tensioning plate 5 engage into oblong holes 67*a*, 68*a* of locking plate 6. At the same time edge 69*a* of locking plate 6 is aligned on projection 49*a* of retention plate 4, and the front edges of projections 67, 68 are aligned on edge 49*b*. Projection 71 extends between the two projections 70 so that altogether locking plate 6 firmly locks tensioning plate 5 by means of these multiple positive measures. In addition, locking plate 6 is frictionally held by these multiple measures on tensioning plate 5 and retention plate 4 in a direction vertical to the snowboard surface (z direction). The locking plate can also be selectively secured by a screw (not shown) that is screwed through hole 66 into opening 56*a*.

If one wants to adjust the binding later, the locking plate must first be raised off. To this end recess 49*c* is provided on projection 49*a* via which recess one can reach with one finger under locking plate 6 and raise it.

Thus, an adjustment of the binding in the x direction and y direction can be carried out very simply with few manual operations and without additional tools. Locking plate 6 functions itself as a tool and has the double function of locking and of a tool.

FIG. 3 shows a section of the binding in the assembled state. In the sectional view selected, locking pins 64, 65 are not visible and are indicated only by dotted lines. The same applies in an analogous manner to the engagement between projections 57 and 58 and oblong holes 67*a* and 68*a*. By virtue of the identical reference numbers, FIG. 3 in combination with the above specification is readily understandable to an expert in the art.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above methods and products without departing from the scope of the invention, it is intended that all matter contained in the above description and shown in the accompanying drawings shall be interpreted as illustrative and not in a limiting sense.

What is claimed is:

1. A snowboard binding comprising:

a base plate that can be fastened at a spacing from a surface of a snowboard;

a pin plate arranged between the surface of the snowboard and the base plate, from which pin plate a plurality of pins project that extend through associated recesses of the base plate;

a mounting plate comprising a central opening;

a retention plate comprising openings for receiving pins, wherein the retention plate extends over the opening of the mounting plate; and a tensioning device for fixing the retention plate, the mounting plate and the pin plate on the base plate;

wherein each of the pins has an annular groove; and wherein the tensioning device comprises a tensioning plate with oblong holes formed like circular ring segments, associated with the pins and at least one lateral wall of the oblong holes has an oblique run-up surface that engages into the particular annular groove of the pins.

2. The snowboard binding according to claim 1, characterized in that the pin plate comprises four arms arranged in a cross pattern from the ends of which the pins project and in that the arms located in a straight line relative to one another have a different length than the arms standing perpendicularly to them.

3. The snowboard binding according to claim 1, characterized in that a cogging running in a straight line is provided on the top of the pin plate and a corresponding countercogging is provided on the bottom of the base plate.

4. The snowboard binding according to claim 3, characterized in that the openings of the base plate are oblong holes whose longitudinal direction is aligned perpendicularly to the direction of the cogging.

5. The snowboard binding according to claim 4, characterized in that the retention plate has rows of passage holes associated with each of the pins and in that the rows are arranged parallel to each other and perpendicularly to the oblong holes of the base plate.

6. The snowboard binding according to claim 1, characterized in that a locking plate with at least one vertically projecting, eccentric pin is provided, and in that the tensioning plate and the retention plate have holes associated with this at least one pin, wherein the pins and the holes are arranged and aligned in such a manner that in the locking position of the tensioning plate these holes are aligned with each other so that the pin can be set into these holes.

7. The snowboard binding according to claim 6, characterized in that the tensioning plate comprises two projections located on a diameter line and projecting vertically from the top of the tensioning plate and in that the locking plate comprises holes associated with them, which cited projections and the holes are arranged and aligned in such a manner to each other that the projections engage into the holes in the locking position of the tensioning plate.

8. The snowboard binding according to claim 7, characterized in that the projections comprise recesses and that the locking plate comprises projections on a lateral edge that can be set into these recesses in order to rotate the tensioning plate.

9. The snowboard binding according to claim 6, characterized in that the tensioning plate comprises a central, pin-shaped flange and that the locking plate comprises a central opening associated with this flange.

10. The snowboard binding according to claim 6, characterized in that the retention plate comprises at least one substantially straight-line projection projecting vertically from its surface and that the locking plate comprises straight-line edges associated with these projections.

11. The snowboard binding according to claim 2, characterized in that a locking plate with at least one vertically projecting, eccentric pin is provided, and in that the tensioning plate and the retention plate have holes associated with this at least one pin, wherein the pins and the holes are arranged and aligned in such a manner that in the locking position of the tensioning plate these holes are aligned with each other so that the pin can be set into these holes.

12. The snowboard binding according to claim 3, characterized in that a locking plate with at least one vertically projecting, eccentric pin is provided, and in that the tensioning plate and the retention plate have holes associated with this at least one pin, wherein the pins and the holes are arranged and aligned in such a manner that in the locking position of the tensioning plate these holes are aligned with each other so that the pin can be set into these holes.

13. The snowboard binding according to claim 4, characterized in that a locking plate with at least one vertically projecting, eccentric pin is provided, and in that the tensioning plate and the retention plate have holes associated with this at least one pin, wherein the pins and the holes are arranged and aligned in such a manner that in the locking position of the tensioning plate these holes are aligned with each other so that the pin can be set into these holes.

14. The snowboard binding according to claim 5, characterized in that a locking plate with at least one vertically projecting, eccentric pin is provided, and in that the tensioning plate and the retention plate have holes associated with this at least one pin, wherein the pins and the holes are arranged and aligned in such a manner that in the locking position of the tensioning plate these holes are aligned with each other so that the pin can be set into these holes.

15. The snowboard binding according to claim 7, characterized in that the tensioning plate comprises a central, pin-shaped flange and that the locking plate comprises a central opening associated with this flange.

16. The snowboard binding according to claim 8, characterized in that the tensioning plate comprises a central, pin-shaped flange and that the locking plate comprises a central opening associated with this flange.

17. The snowboard binding according to claim 7, characterized in that the retention plate comprises at least one substantially straight-line projection projecting vertically from its surface and that the locking plate comprises straight-line edges associated with these projections.

18. The snowboard binding according to claim 8, characterized in that the retention plate comprises at least one substantially straight-line projection projecting vertically from its surface and that the locking plate comprises straight-line edges associated with these projections.

19. The snowboard binding according to claim 9, characterized in that the retention plate comprises at least one substantially straight-line projection projecting vertically from its surface and that the locking plate comprises straight-line edges associated with these projections.

* * * * *